US007162177B2

(12) United States Patent
Fiore et al.

(10) Patent No.: US 7,162,177 B2
(45) Date of Patent: Jan. 9, 2007

(54) BACK OF THE BELT CLEANER IN AN IMAGING SYSTEM

(75) Inventors: Steven J. Fiore, Hilton, NY (US); Michael N. Soures, Webster, NY (US); Steven R. LeRoy, Hilton, NY (US); Nero R. Lindblad, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 315 days.

(21) Appl. No.: 10/876,708

(22) Filed: Jun. 25, 2004

(65) Prior Publication Data

US 2005/0069339 A1 Mar. 31, 2005

Related U.S. Application Data

(60) Provisional application No. 60/506,545, filed on Sep. 26, 2003.

(51) Int. Cl.
*G03G 15/00* (2006.01)
*G03G 21/00* (2006.01)

(52) U.S. Cl. ..... 399/99; 399/101; 399/297; 399/353

(58) Field of Classification Search ..... 399/98, 399/99, 101, 162–165, 297, 352–354; 15/256.5, 15/256.51, 256.52
See application file for complete search history.

(56) References Cited

U.S. PATENT DOCUMENTS

| | | | | |
|---|---|---|---|---|
| 2,832,977 | A | 5/1958 | Walkup et al. | |
| 3,722,018 | A | 3/1973 | Fisher | 15/1.5 |
| 4,435,073 | A | 3/1984 | Miller | |
| 4,851,880 | A | 7/1989 | Ziegelmuller et al. | |
| 5,315,358 | A | 5/1994 | Parks et al. | |
| 5,394,224 | A * | 2/1995 | Irobe | 399/99 |
| 5,771,424 | A | 6/1998 | Lindblad et al. | 399/71 |
| 5,784,674 | A * | 7/1998 | Iseki et al. | 399/297 |
| 6,259,882 | B1 * | 7/2001 | Lindblad et al. | 399/352 |
| 6,418,285 | B1 | 7/2002 | Casella et al. | 399/162 |
| 6,961,534 | B1 * | 11/2005 | Fiore et al. | 399/353 |

FOREIGN PATENT DOCUMENTS

| | | |
|---|---|---|
| EP | 0 472 401 A2 | 2/1992 |
| EP | 0 747 788 A2 | 12/1996 |

* cited by examiner

*Primary Examiner*—William J. Royer
(74) *Attorney, Agent, or Firm*—Oliff & Berridge, PLC

(57) ABSTRACT

A rotating cleaning brush positioned to clean toner and debris from the back of an imaging belt. Additionally, a plurality of cleaning brushes assembled to clean the back of the imaging belt wherein charging a first and a second brush to approximately equal potential but opposite polarity provides superior discharge of static and other electrical charges from the back of the imaging belt.

28 Claims, 3 Drawing Sheets

BACK OF THE BELT CLEANER IN AN IMAGING SYSTEM

This application claims the benefit of Provisional Patent Application No. 60/506,545, filed Sep. 26, 2003.

BACKGROUND AND SUMMARY

The present invention relates to the technology for removing residual ink and debris from an imaging surface of a printing system and more particularly to the cleaning of such residual ink and debris from the back of an imaging belt.

Modern high speed and high quality printers require great precision in spacing tolerances and alignment within key imaging subsystems. Such precision is particularly important within the image development subsystem of electrostatographic imaging systems where toner ink is transferred from a donor element to a latent image characterized by differential charges on an imaging surface. Any significant variation across the imaging width in the gap between the donor element and the imaging surface results in irregular image density and in other imaging defects. Where the imaging surface comprises a flexible endless belt moving in relation to the donor element, maintaining precise tolerances is particularly difficult. In response, backer bars or other web guide members are commonly used to provide, support, tension, and precise alignment and tolerances of the belt as it moves through key imaging subsystems, including the development subsystem.

Even with precisely placed and aligned backer bars, experience has shown that residual toner and debris that collects on the back of a moving photoreceptor or other imaging surface can sufficiently distort tolerances to introduce imaging anomalies. Such residual toner and debris results from toner that escapes from the development subsystem or from a primary or secondary cleaning system, from toner shaken off the image surface or copy substrates, or from paper fibers and other debris that enters the system with copy substrates. Although much care is made to inhibit such toner and debris and to collect it as much as possible, some toner and debris escapes and is attracted to the back of the imaging belt, particularly when the back of the belt carries an electrical charge. Although the total amount of toner and debris is small, it can eventually accumulate on surfaces contacted by the back of the belt. Such surfaces include, without limitation, backer bars and other web guide members. After enough accumulation in critical areas, required tolerances and alignments can be lost. This is particularly true with newer toner development systems such as hybrid scavengeless development (HSD") and hybrid jumping development ("HJD") systems. In these systems, toner is made to form a cloud of charged toner particles within the development gap. Toner particles are attracted out of such cloud toward the image areas on the imaging surface, which are oppositely charged. Toned images are thereby formed on the image surface. If the backer bars, which set the development gap between the photoreceptor and the donor elements, accumulate any significant amount of toner or debris, then the precise tolerances required across the entire image width of the gap are lost, and imaging defects result.

Among the various methods that might be considered for cleaning the inside of an imaging belt are rotating cylindrical brushes similar to those that are used to clean residual toner and debris from the imaging surface itself. The following references disclose various aspects of imaging surface cleaning systems that may be relevant to back of the belt cleaning systems, and the following references are hereby incorporated herein by reference in their entirety:

U.S. Pat. No. 2,832,977, discloses a rotatable brush mounted in close proximity to the photoreceptor surface to be cleaned and the brush is rotated so that the brush fibers continually wipe across the photoreceptor. In order to reduce the dirt level within the copier, a vacuum system is provided which pulls loosely held residual toner from the brush fibers and exhausts the toner from the copier. To assist the vacuum system in removal of the residual toner, the brush fibers are treated with a neutralizing ion spray from a corona generating device. This ion spray is intended to negate any triboelectrification generated when the brush wipes across the photoreceptor surface. Unfortunately, the brush becomes contaminated with toner after extended usage and has to be replaced more frequently than desired. With increased processing speeds of copiers and printers, the foregoing brush cleaning technique is not practical without improvements.

U.S. Pat. No. 3,722,018 discloses a more efficient residual toner cleaning system by positioning a corona generating device in the residual toner cleaner of U.S. Pat. No. 3,572,923 to induce a charge on the brush fibers and toner thereon of a polarity opposite that of a biased transfer roll, so that the toner collected by the brush are efficiently transferred from the brush to the roll. U.S. Pat. No. 3,780,391 discloses that toner removal from the brush can also be accomplished by the use of an electrically biased flicker bar.

U.S. Pat. No. 4,435,073 discloses a rotatable cylindrical brush cleaning apparatus for removing toner particles from a photoconductive surface. The brush is supported for rotation in a housing. The housing has an opening confronting the photoconductive surface and an aperture communicating through a conduit with a vacuum source. The brush extends from the housing opening into contact with the photoconductive surface. A plurality of flicker bars are mounted in the interior of the housing and in an air stream created by the vacuum source. The flicker bars are fabricated from materials which will not only cause the brush fibers to become electrostatically charged through wiping contact with the bars, but will cause the charge on the brush to reverse at least once for each revolution of the brush.

U.S. Pat. No. 4,851,880 discloses a rotating cylindrical brush and vacuum cleaning apparatus for removing toner particles from an image-bearing surface of a copier or printer. A housing that surrounds and substantially encloses the brush has an open portion adjacent the image-bearing surface. The brush extends through the open portion of the housing and into engagement with the image-bearing surface. The rotation of the brush is in a direction opposite to the direction of movement of the image-bearing surface. An elongated slot is located in the housing generally opposite the open portion and connects the interior of the housing to a vacuum source. Adjacent to the slot and on the interior of the housing is an airfoil to compress the brush fibers as the brush rotates thereby to loosen the toner particles in the brush fibers collected from the image-bearing surface. This loosening of the toner particles allows the vacuum to extract the toner particles through the housing slot. In an alternate embodiment, an additional airfoil of equal size is provided on the opposite side of the slot. The two airfoils compress the brush fibers on both sides of the slot and forces the air stream generated by the vacuum source to flow through brush fibers from opposite directions prior to exiting the housing through the slot.

U.S. Pat. No. 5,315,358 discloses one or more rotatable cylindrical brushes mounted in a housing having an opening therein to enable the brush or brushes to extend therefrom and into contact with a moving photoconductive surface to remove toner particles therefrom. A flicker bar is removably mounted within the housing and has an integral air channel therein. A vacuum source connected to the air channel in the flicker bar withdraws air and particles from the brush and housing. The solitary construction of the flicker bar provides a properly sized air channel that does not vary due to assembly tolerances.

Counterbalanced against the need to remove residual toner and debris is the need to make any cleaning system work within the extremely tight confines of the space within the belt loop itself. This space inside the belt is generally consumed by rollers, drive devices, supporting frames, etc. It is undesirable to lengthen the belt in order to add additional subsystems since such increase in belt size leads to increased size, cost, and weight of the overall printing system itself. Additionally, each additional subsystem and part within adds complexity and cost.

Another consideration when designing a back of the belt cleaning system is control of static charge build-up on the back of the imaging belt. Since the photoreceptor contains at least one insulating layer, charges can build on the back of the belt without being removed by the charging and discharging that occurs during the imaging cycle on the imaging side of the belt. Accordingly, it is common to utilize a static electricity removal device such as a grounded conductive brush. The static removal device typically does not cover the entire width of the belt but instead covers only a sufficient width to remove enough charge to prevent harmful static charge build-up. Even if such a grounded brush or other conductor covered the entire width, such passive grounding is believed to leave some irregularly spaced charges on the back of the belt due in part to the role that the insulating layer(s) of the belt play in preventing rapid conduction of charge from the belt to ground. Uneven electrical charge on the back of the belt is believed to affect the uniformity of charge attainable on the front of the belt.

Accordingly, it would be desirable to develop an effective, relatively low cost and compact system for cleaning residual toner and debris from the inside of an imaging belt. It would also be desirable to develop a system for uniformly removing charges from the back of an imaging belt such as a photoreceptor belt.

One embodiment of the invention is a brush cleaner assembly for cleaning the back side of an imaging web having a width, comprising: a support structure located proximate to the back side of the web; a brush rotatably mounted on the support structure in an interfering relationship with the back side of the web such that a substantial portion of the width of the back side of the web is swept upon rotation of the brush; and a drive device, coupled to the rotatable brush, for imparting rotational force to the rotatable brush.

Another embodiment of the invention is a method for cleaning the back side of an imaging web having a width, comprising: locating a support structure proximate to the back side of the web rotatably mounting a brush on the support structure in an interfering relationship with the back side of the web such that a substantial portion of the width of the back side of the web is swept upon rotation of the brush; and imparting rotational force to the rotatable brush.

Yet another embodiment of the invention is an electrophotographic printer comprising: a brush cleaner assembly for cleaning the back side of an imaging web having a width, said cleaner assembly comprising a support structure located proximate to the back side of the web; a brush rotatably mounted on the support structure in an interfering relationship with the back side of the web such that a substantial portion of the width of the back side of the web is swept upon rotation of the brush; and a drive device, coupled to the rotatable brush, for imparting rotational force to the rotatable brush.

DETAILED DESCRIPTION

Figure 1:
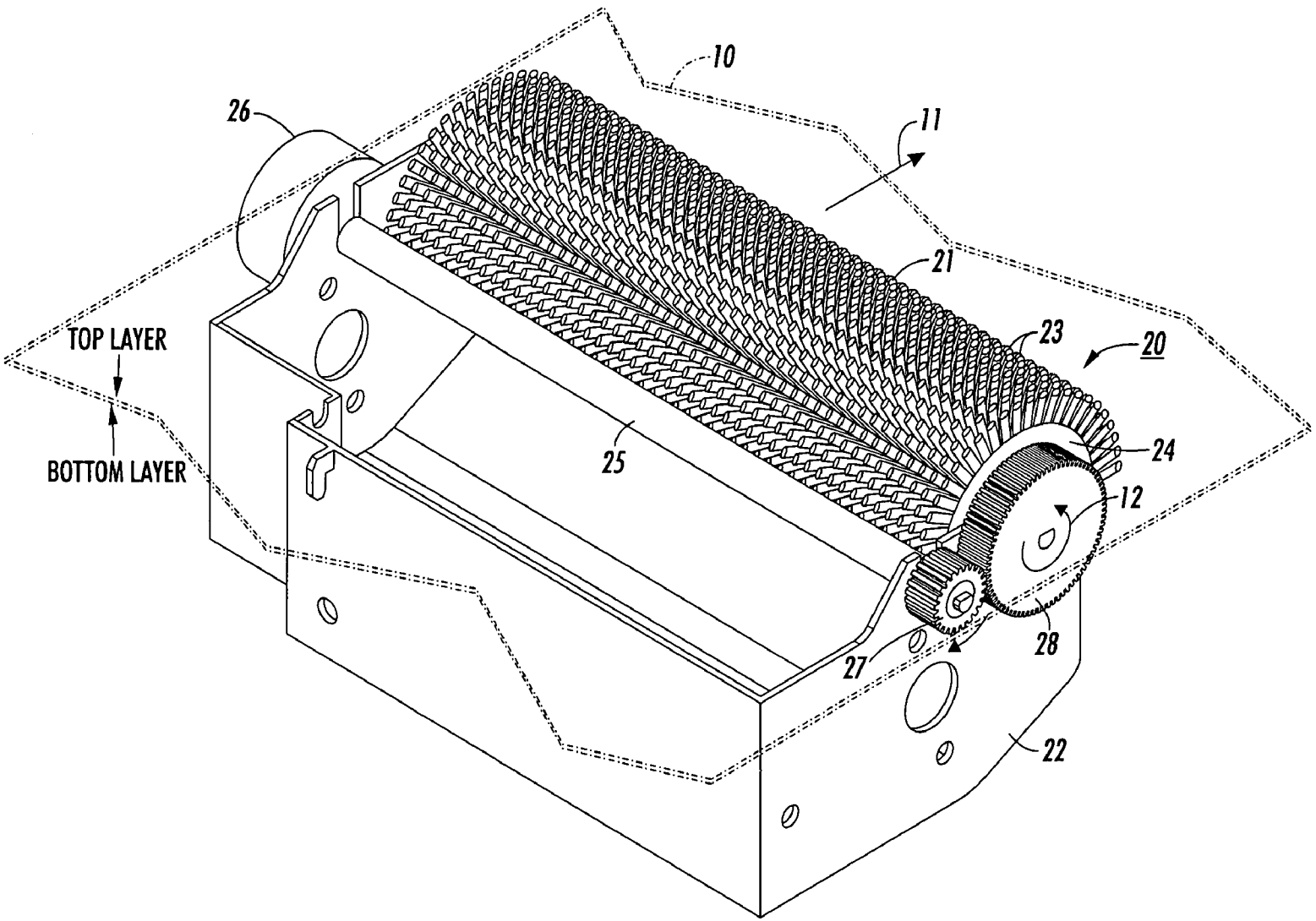
FIG. 1 is an elevated perspective view of a single brush and single flicker bar assembly of one embodiment of the invention.

For a general understanding of the present invention, reference is made to the drawings. In the drawings, like reference numerals have been used throughout to designate identical elements.

An exemplary electronic system comprising one embodiment of the present invention is a multifunctional printer with print, copy, scan, and fax services. Such multifunctional printers are well known in the art and may comprise print engines based upon ink jet, electrophotography, and other imaging devices. The general principles of electrophotographic imaging are well known to many skilled in the art. Generally, the process of electrophotographic reproduction is initiated by substantially uniformly charging a photoreceptive member, followed by exposing a light image of an original document thereon. Exposing the charged photoreceptive member to a light image discharges a photoconductive surface layer in areas corresponding to non-image areas in the original document, while maintaining the charge on image areas for creating an electrostatic latent image of the original document on the photoreceptive member. This latent image is subsequently developed into a visible image by a process in which a charged developing material is deposited onto the photoconductive surface layer, such that the developing material is attracted to the charged image areas on the photoreceptive member. Thereafter, the developing material is transferred from the photoreceptive member to a copy sheet or some other image support substrate to which the image may be permanently affixed for producing a reproduction of the original document. In a final step in the process, the photoconductive surface layer of the photoreceptive member is cleaned to remove any residual developing material therefrom, in preparation for successive imaging cycles.

The above described electrophotographic reproduction process is well known and is useful for both digital copying and printing as well as for light lens copying from an original. In many of these applications, the process described above operates to form a latent image on an imaging member by discharge of the charge in locations in which photons from a lens, laser, or LED strike the photoreceptor. Such printing processes typically develop toner on the discharged area, known as DAD, or "write black" systems. Light lens generated image systems typically develop toner on the charged areas, known as CAD, or "write white" systems. Embodiments of the present invention apply to both DAD and CAD systems. Since electrophotographic imaging technology is so well known, further description is not necessary. See, for reference, e.g., U.S. Pat. No. 6,069,624 issued to Dash, et al. and U.S. Pat. No. 5,687,297 issued to Coonan et al., both of which are hereby incorporated herein by reference.

Referring to FIG. 1, one exemplary embodiment of a back of the belt cleaning system is shown as cleaning system 20. The primary component of cleaning system 20 is rotating electrostatically charged brush 21, which is mounted in housing 22. Brush 21 is rotated in a direction opposite to that of the inside of a photoreceptor belt 10, as indicated by arrows 11 and 12. Rotational speed of the brush 21 is between about 10 and about 100 RPM and preferably about 15 RPM, which is considerably less than the typical 200–300 RPM of a primary brush cleaner for removing toner and debris from an imaging surface. The brush 21 has an overall diameter of about 40 mm with fibers 23 extending radially from a conductive sleeve 24 for a distance of from about 10 to about 17 mm and preferably about 12.5 mm. The brush 21 has an electrical bias of between about 150 to about 600 Volts and preferably about 215 Volts. In the exemplary single brush system shown in FIG. 1, the polarity of the electrical bias is opposite to that of the charged toner during image development. The brush fiber 23 have a diameter of 10 denier or about 35 pm and contact the back of the belt 10 with an interference of between about 1.5 and about 3.0 mm, preferably about 2.16 mm. The combination of the electrical bias of the brush 21 and the sweep of the brush fibers 23 against the back of the photoreceptor surface effectively cleans and removes the residual toner and debris therefrom.

In contrast to primary cleaning systems for cleaning residual toner and debris from the imaging surface, positioning of cleaning system 20 around the inside of belt 10 is not particularly important. This is because the rate of build-up of residual toner and debris is not sufficiently great to require cleaning before a particular imaging operation. Preferably, however, inside the belt cleaning system 20 is placed prior to the development subsystem. Wherever placed, continual operation of cleaning system 20 ensures cleaning of the inside of belt 10 at least once each revolution.

Flicker bar 25 is made of any suitable material having low friction, nonwearing properties with respect to the material of the brush fibers 23, and non-sticking with respect to toner particles. High-density polyethylene has been found to be a suitable material for flicker bars. Nylon and acrylic fibers are also usually suitable. In the exemplary embodiment of FIG. 1, the material used is SA-7® from the Toray Company. Flicker bar 25 is mounted in housing 22 in interfering contact with rotating brush 21. The amount of interference between flicker bar 25 and brush fibers 23 is between about 1.5 mm and about 4 mm, preferably about 2.5 mm. As the brush fibers rotate past the flicker bar, the brush fibers 23 are deformed and compressed, so that once the brush fibers 23 have passed from contact with the flicker bar, the brush fibers 23 straighten rapidly towards their original outward extension from conductive brush sleeve 24. This rapid whipping action of brush fibers 23 accelerates toner particles and debris captured on the fibers such that such toner and debris attains sufficient centrifugal force to overcome the forces adhering the toner and debris to the fibers. In this way, the toner and debris is "flicked" off brush 21, and brush 21 is prevented from becoming so full of toner and debris that it can no longer clean.

Unlike conventional flicker bars, bar 25 is rotationally mounted to housing 22 and rotationally driven by motor 26. As noted above, the rotational speed of brush 21 in this embodiment is approximately an order of magnitude less than the rotational speed of conventional brushes used to clean imaging surfaces. As a result, the amount of centrifugal force at the tips of each brush fiber 23 are considerably less than the forces in conventional brush systems. More toner and debris is accordingly expected to stick to the flicker bar 25 itself rather than to be flung away. Rotation of flicker bar 25 alleviates this problem since the arc segment of the bar 25 that interferes with brush fibers 23 continually changes and itself becomes cleaned by the brush fibers 23 as flicker bar 25 rotates. Additionally, much greater area of flicker bar 25 is used for such interference so that the density of any particles that stick to flicker bar 25 is accordingly less. Without rotation, it is possible for flicker bar 25 and brush fibers 23 to trade toner and debris between themselves without sufficiently removing the toner and debris from the back of the belt 10.

Another advantage of rotating flicker bar 25 results from using the rotation of flicker bar 25 to drive rotation of brush 21. Because brush 21 rotates between about 10 to about 100 RPM, and preferably about 15 RPM, reduction fro the rotational speed of motor 26 is required. Space inside the confines of belt 10 is extremely tight for the reasons described above, and a motor and gear system to drive brush 21 separately from flicker bar 25 would add both expense and space. Accordingly, flicker bar 25 itself is used to convey rotational drive from motor 26 to brush 21. Gear reduction is accomplished by attaching a relatively small gear such as 20-tooth gear 27 to the end of flicker bar 25. Gear 27, in turn, engages large gear 28, which is mounted to the end of and drives brush 21. Gear 28 may have about 60 teeth in order to give a 3-1 gear reduction between flicker bar 25 and brush 21. Reductions from about 2-1 to about 5-1 are also reasonable. Yet another advantage of this arrangement is the ability to position some of the space consuming hardware on one side of cleaning system 20 and the remainder on the other side. If both the motor 26 and all of the gears 27, 28 were placed on the same side, too much space on that side is likely to be consumed, thereby leading to the undesirable need to increase the size and cost of the entire system. In FIG. 1, gears 27 and 28 are shown directly coupled as is rotating brush 21 and rotating flicker bar 25. One skilled in the art will recognize that such coupling may comprise any assortment of drive coupling mechanisms and may include intermediate gears or other coupling mechanisms.

Figure 2:
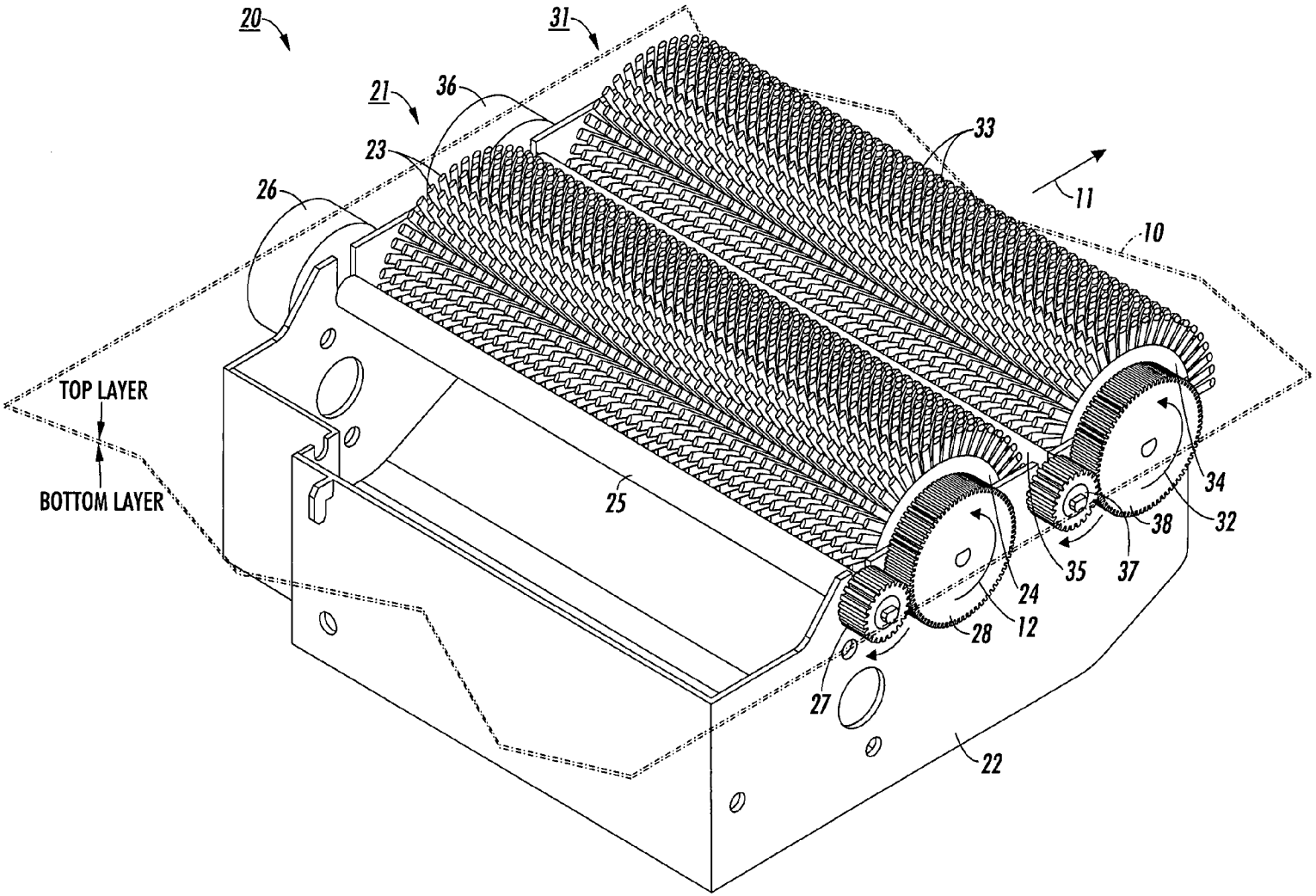
FIG. 2 is an elevated perspective view of a dual brush and dual flicker bar assembly of one embodiment of the invention.

Referring to FIG. 2, a dual brush back of the belt cleaning system 20 is shown. In this embodiment, dual brushes 21, 31 and flicker bars 25, 35 each operate in the same manner as shown in FIG. 1. One brush and flicker bar system is labeled identically as in FIG. 1 while the second brush is labeled with corresponding numbers scaled a decade higher. One skilled in the art will readily understand that one motor could. Drive both systems with appropriate gearing or other coupling.

Brush 21 is negatively charged by connection to a first power source (not shown) whereas brush 31 is positively charged by connection with a second power source (not shown). The first and second power sources can be DC only power sources or may generate AC oscillating current with appropriate DC rectifiers. In one possible configuration, the first and second power sources are combined into one AC current source that is split with the positive polarity of its signal being directed to brush 31 and the negative polarity being directed to brush 21. Additionally, it is understood that the polarity of brushes 21 and 31 can be reversed.

The result of a dual brush, back of the belt system with each brush having opposite polarity is a more uniform charging and discharging of charges from the back of the belt. When each brush is charged to between about 200 and about 500 Volts and preferably about 300 Volts of opposite polarity, the first brush uniformly charges the entire width of belt 10 with a charge of a first polarity. Any pre-existing static on the belt 10 is subsumed within the 200–500 Volt charge to create uniformity. The opposite and equal polarity of the next brush then erases or neutralizes the charge across the full width of the belt 10. The result is that this active charge removal system creates significantly more charge uniformity on the back of the belt 10 than the conventional passive charge removal systems. More uniform charges on the back of the belt 10, in turn, are believed to enable more uniform pre-imaging charging on the front of the belt 10. More uniform charging, in turn, leads to more uniform imaging provided that all other variables are equal. As an added benefit, dual brushes provide more cleaning than a single brush. In particular, if each section of belt 10 encounters upstream brush 31 first, then maximum cleaning of toner particle debris occurs if brush 31 is charged to the polarity opposite the charge polarity of the toner. Most toner and related debris then are picked up by upstream brush 31 in the same manor as shown for a single brush system such as that shown in FIG. 1. The downstream brush, 21, then provides additional cleaning action while neutralizing the charge upon belt 10 by contacting belt 10 with a charge equal to and opposite brush 31. In this manner, both debris and static charge build-up are optimally cleaned from the back of belt 10. The example shown in FIG. 2 has brush 31 connected to a negative polarity source (unshown), thereby indicating that toner in this system is positively charged to be attracted to negative imaging areas.

Figure 3:
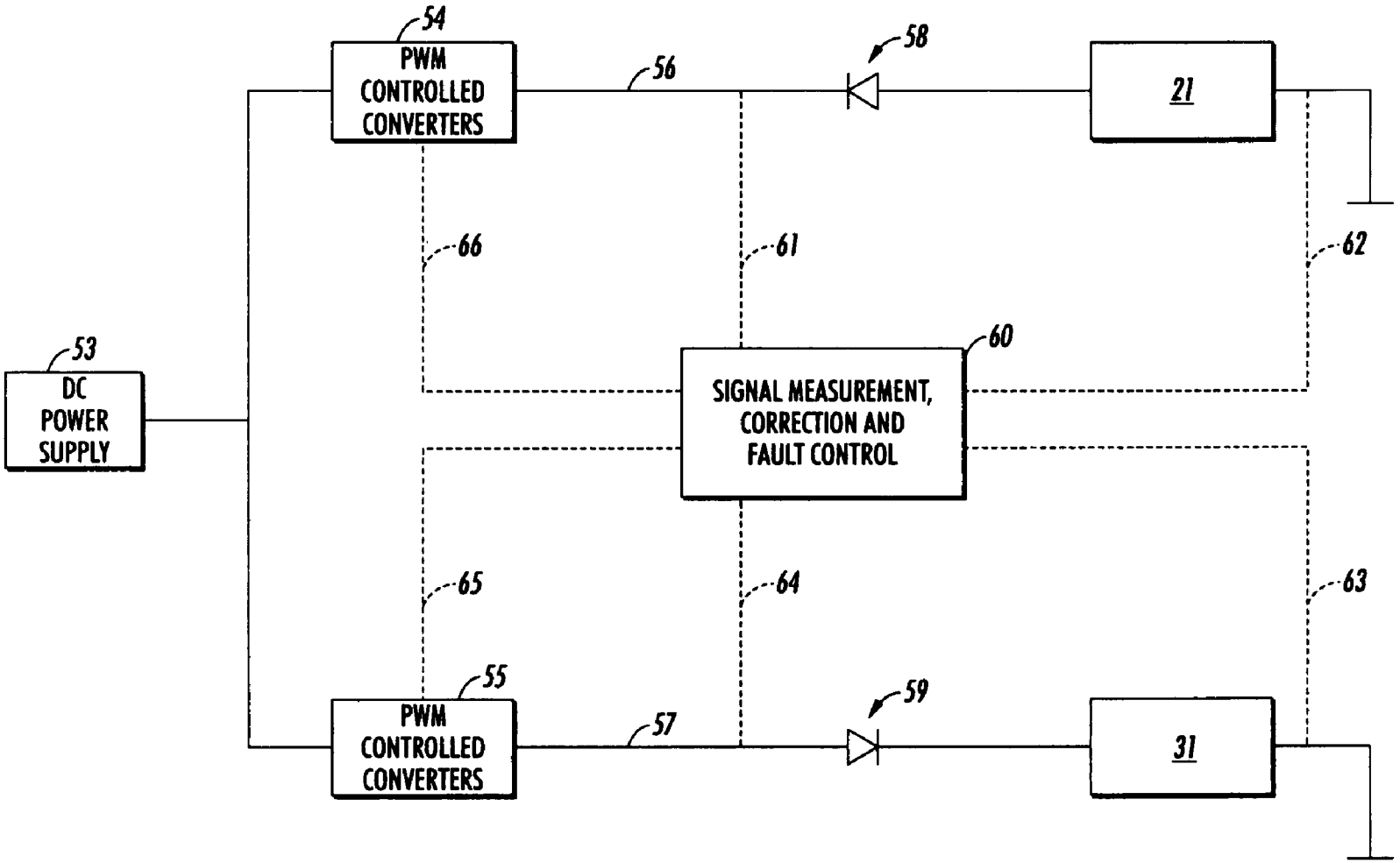
FIG. 3 is a schematic diagram of an exemplary circuit for using a DC current source to provide equal and opposite polarity current to a dual brush cleaning system.

Referring to FIG. 3, an exemplary DC-sourced circuit is shown for providing equal but opposite charges to each of the brushes in a dual brush cleaning system. In this example, DC power supply 53 provides DC current which is split, or bifurcated, into circuits directed to brush 21 and brush 31, respectively. In each circuit, a pulse wave modulator controlled converter, 54 and 55, respectively, converts the DC current into pulsed AC current (typically in a square wave signal). Current is carried from converters 54 and 55 through lines 56 and 57 to respective rectifying diodes 58 and 59. Diode 58 emits the negative portion of the pulsed signal, thereby charging brush 21 to a negative potential. Diode 59 emits the positive portion of the pulsed signal, thereby charging brush 31 to a positive potential. The schematic circuit of FIG. 3 thus achieves the polarity result as in FIG. 2 although using one power source rather than two. One skilled in the art recognizes that some imaging systems operate using the opposite polarities, and such reversal of polarities is within the scope of the invention.

In addition to DC power supply 53 being used to charge brushes 21 and 31 to opposite polarities, FIG. 3 also shows a schematic for a signal measurement, correction and fault control device 60. This device operates by receiving signals from lines 56 and 57 through lines 66 and lines 65, respectively. These signals are measured and compared by device 60 to ensure that signals of equal voltage, amperage, and pulse shape are being sent to respective brushes 21 and 31. Any corrective signal is sent back to lines 56 or 57 through respective lines 61 and 64. One skilled in the art will recognize that signal measurement, correction, and fault control circuits and devices such as device 60 are well known in the art and may be accomplished by a wide variety of particular circuit elements such as lines 62 and 63. Use of such a measurement and correction device helps ensure that the charges on brushes 21 and 31 are equal but of opposite polarity in order to optimize static charge removal.

In review, embodiments of the back of the belt cleaning system of the present invention include a rotating flicker bar that enables more compact and inexpensive drive of a cleaning brush while also better removing residual toner and debris from the fibers of the brush. Additionally, dual cleaning brushes charged with opposite polarity provide superior means for uniformly discharging static charges from the back of an imaging belt.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A brush cleaner assembly for cleaning the back side of an imaging web having a width, comprising:

a support structure located proximate to the back side of the web;

a brush rotatably mounted on the support structure in an interfering relationship with the back side of the web such that a substantial portion of the width of the back side of the web is swept upon rotation of the brush wherein the brush comprises at least one of a brush comprising brush fibers that interfere with the back side of the web between about 1.5 to about 3.0 millimeters, a brush electrically charged between about 200 to about 500 volts, a brush rotated from between about 10 to about 100 revolutions per minute, and a brush comprising a plurality of brushes; and a drive device, coupled to the rotatable brush, for imparting rotational force to the rotatable brush.

2. The brush cleaner assembly of claim 1, wherein the brush fibers interfere with the back side of the web about 2.16 millimeters.

3. The brush cleaner assembly of claim 1, wherein the brush is electrically charged to about 300 volts.

4. The brush cleaner assembly of claim 1, wherein the brush is rotated about 15 revolutions per minute.

5. The brush cleaner assembly of claim 1, further comprising a power source electrically connected to the plurality of brushes wherein a first brush is charged to a certain electrical potential with one polarity and a second brush is charged to about the same electrical potential with the opposite polarity.

6. The brush cleaner assembly of claim 5, wherein the power source emits an AC signal wherein such signal is split to send signals of opposing polarity to the first and to the second brush.

7. The brush cleaner assembly of claim 5, wherein the power source comprises a bipolar power source with one polarity signal routed to the first brush and the other polarity routed to the second brush.

8. The brush cleaner assembly of claim 5, wherein:

the imaging web comprises part of an imaging system using imaging particles initially charged to one polarity;

the first brush is upstream of the second brush relative to the direction of travel of the web; and the first brush is charged to the opposite polarity as the imaging particles.

9. The brush cleaner assembly of claim 5, wherein the first brush is charged to a negative polarity.

10. The brush cleaner assembly of claim 5, wherein the power source further comprises:

a DC current power source; and at least one device for converting DC current into alternating polarity current.

11. The brush cleaner assembly of claim 10, wherein the current is bifurcated prior to conversion into alternating polarity current.

12. The brush cleaner assembly of claim 10, further comprising at least one rectifying device electrically connected to the first brush for rectifying current routed to the first brush.

13. The brush cleaner assembly of claim 10, further comprising a signal measurement and correction circuit electrically connected to both brushes for measuring electrical charges delivered to each brush and for sending corrective signals based upon such measurements.

14. A method for cleaning the back side of an imaging web having a width, comprising:

locating a support structure proximate to the back side of the web;

rotatably mounting a brush on the support structure in an interfering relationship with the back side of the web such that a substantial portion of the width of the back side of the web is swept upon rotation of the brush; and imparting rotational force to the rotatable brush, wherein an action performed on the brush comprises at least one of interfering brush fibers of the brush with the back side of the web between about 1.5 to about 3.0 millimeters, rotating the brush between about 10 to about 100 revolutions per minute, and electrically charging the brush between about 200 to about 500 volts.

15. The method of claim 14 for cleaning the back side of an imaging web, wherein the brush fibers interfere with the back side of the web about 2.16 millimeters.

16. The method of claim 14 for cleaning the back side of an imaging web, wherein the brush is electrically charged to about 300 volts.

17. The method of claim 14 for cleaning the back side of an imaging web, wherein the brush is rotated about 15 revolutions per minute.

18. An electrophotographic printer comprising a brush cleaner assembly for cleaning the back side of an imaging web, said brush cleaner assembly comprising:

a support structure located proximate to the back side of the web;

a brush rotatably mounted on the support structure in an interfering relationship with the back side of the web such that a substantial portion of the width of the back side of the web is swept upon rotation of the brush wherein the brush comprises at least one of a brush comprising brush fibers that interfere with the back side of the web between about 1.5 to about 3.0 millimeters, a brush electrically charged between about 200 to about 500 volts, a brush rotated from between about 10 to about 100 revolutions per minute, and a brush comprising a plurality of brushes; and a drive device, coupled to the rotatable brush, for imparting rotational force to the rotatable brush.

19. A method for cleaning the back side of an imaging web having a width, comprising:

locating a support structure proximate to the back side of the web;

rotatably mounting a plurality of brushes on the support structure in an interfering relationship with the back side of the web such that a substantial portion of the width of the back side of the web is swept upon rotation of the brushes; and imparting rotational force to the rotatable brushes.

20. The method of claim 19 for cleaning the back side of an imaging web, further comprising connecting the plurality of brushes to at least one electrical power source wherein a first brush is charged to a certain electrical potential of one polarity and a second brush is charged to about the same electrical potential with the opposite polarity.

21. The method of claim 20 for cleaning the back side of an imaging web, wherein the power source emits an AC signal wherein such signal is split to send signals of opposing polarity to the first and to the second brush.

22. The method of claim 20 for cleaning the back side of an imaging web, wherein the power source comprises a bipolar power source with one polarity signal routed to the first brush and the other polarity routed to the second brush.

23. The method of claim 20 for cleaning the back side of an imaging web, wherein:

the imaging web comprises part of an imaging system using imaging particles initially charged to one polarity;

the first brush is upstream of the second brush relative to the direction of travel of the web; and the first brush is charged to the opposite polarity as the imaging particles.

24. The method of claim 20 for cleaning the back side of an imaging web, wherein the first brush is charged to a negative polarity.

25. The method of claim 20 for cleaning the back side of an imaging web, wherein the power source further comprises:

a DC current power source; and at least one device for converting DC current into alternating polarity current.

26. The method of claim 25 for cleaning the back side of an imaging web, wherein the current is bifurcated prior to conversion into alternating polarity current.

27. The method of claim 25 for cleaning the back side of an imaging web, further comprising at least one rectifying device electrically connected to the first brush for rectifying current routed to the first brush.

28. The method of claim 25 for cleaning the back side of an imaging web, further comprising a signal measurement and correction circuit electrically connected to both brushes for measuring electrical charges delivered to each brush and for sending corrective signals based upon such measurements.

* * * * *